US005542470A

United States Patent [19]

Evens

[11] Patent Number: 5,542,470

[45] Date of Patent: Aug. 6, 1996

[54] CRIMPED JOINT DESIGN FOR CLAMSHELL HEAT EXCHANGER

[75] Inventor: Lance J. Evens, Carrollton, Tex.

[73] Assignee: Lennox Industries, Inc., Dallas, Tex.

[21] Appl. No.: 85,134

[22] Filed: Jun. 29, 1993

Related U.S. Application Data

[63] Continuation of Ser. No. 682,000, Apr. 8, 1991, abandoned.

[51] Int. Cl.[6] ..... F28F 3/12

[52] U.S. Cl. ..... 165/170; 126/119; 29/890.039; 29/514

[58] Field of Search ..... 165/168, 170; 126/119; 403/335, 338, 274; 29/890.039, 463, 514

[56] References Cited

U.S. PATENT DOCUMENTS

| | | | |
|---|---|---|---|
| 697,955 | 4/1902 | Thompson | 29/514 |
| 1,158,576 | 11/1915 | Sonneborn | 126/119 |
| 1,927,174 | 9/1933 | Jones | 126/116 |
| 2,247,849 | 7/1941 | Ritter | 126/116 |
| 3,294,082 | 12/1966 | Norris | 126/116 |
| 3,324,845 | 6/1967 | White | 126/116 |
| 3,807,382 | 4/1974 | Kennedy | 126/116 R |
| 3,813,752 | 6/1974 | Bemrose et al. | 29/890.039 |
| 4,099,928 | 7/1978 | Norback | 29/890.039 |
| 4,298,061 | 11/1981 | Hoeffken | 165/170 |
| 4,460,329 | 7/1984 | Trent | 431/20 |
| 4,467,780 | 8/1984 | Ripka | 126/110 R |
| 4,554,719 | 11/1985 | Lewis | 29/890.039 |
| 4,700,774 | 10/1987 | Schwarz | 165/170 |
| 4,718,484 | 1/1988 | Hoeffken | 165/170 |
| 4,729,207 | 3/1988 | Dempsey et al. | 126/112 |
| 4,739,746 | 4/1988 | Tomlinson | 126/110 R |
| 4,846,268 | 7/1989 | Beldam et al. | 29/890.039 |
| 4,848,314 | 7/1989 | Bentley | 126/116 R |
| 4,887,767 | 12/1989 | Thompson et al. | 236/1 EB |
| 4,896,411 | 1/1990 | Dempsey | 29/890.039 |
| 4,982,785 | 1/1991 | Tomlinson | 165/170 |

FOREIGN PATENT DOCUMENTS

| | | | |
|---|---|---|---|
| 545200 | 10/1922 | France | 165/170 |
| 2551851 | 3/1985 | France | 165/170 |
| 16634 | 7/1968 | Japan | 29/514 |

*Primary Examiner*—Leonard R. Leo
*Attorney, Agent, or Firm*—Banner & Allegretti, Ltd.

[57] ABSTRACT

The edge seal mechanism of the present invention may be used in connection with clamshell or other formed sheet metal heat exchanger apparatus of the kind utilized for directing hot flue gases into a defined combustion chamber and into various forms of flue passes for radiation from such heat exchanger such combustion chamber. The improved edge seal structure for a clamshell heat exchanger of the present invention includes a first plate flange portion, around which a second flange plate portion is wrapped to define a channel for disposition of the first plate flange portion therebetween. The seal between the first and second flange portion is further formed and stabilized by means of a lateral bend in the first and second flange portions, with such lateral bend being in the direction of and toward the terminal portion of the second plate flange in order to secure maintenance of the seal between the first and second plate flange portions.

11 Claims, 1 Drawing Sheet

CRIMPED JOINT DESIGN FOR CLAMSHELL HEAT EXCHANGER

This application is a continuation of application Ser. No. 07/682,000, filed Apr. 8, 1991, abandoned.

BACKGROUND OF THE INVENTION

The present invention relates generally to heat exchangers, such as those usable in forced air furnaces, and more particularly to an improved edge seal mechanism for heat exchangers of clamshell construction.

In the prior art, heat cxchangers of the clamshell type have been developed and utilized, based upon several advantages including their greater economy in fabrication, efficiency in use, etc. Such clamshell heat cxchangers arc formed from a matched pair of sheet metal workpieces, into which indentations are formed, to define upon joining thereof a passageway between such opposed clamshell elements for the hot products of combustion, which arc circulated therethrough for radiation therefrom.

In the prior art, clamshell heat exchangers have been joined at the edges by a variety of different mechanisms. For example, in each of U.S. Pat. No. 3,294,082 to Norris, U.S. Pat. No. 1,9207,174 to Jones, U.S. Pat. No. 3,324,845 to White, and U.S. Pat. No. 3,807,382 to Kennedy, various forms of planar flange elements are taught. Such planar flange elements may be joined in a variety of ways, including the disposition of a channel clement over the terminal portion of the planar flange elements for maintenance thereof in operative and sealing disposition, such as for example set forth in U.S. Pat. No. 1,927,174 to Jones. Of course, these planar flange elements and other edge joining elements have also been welded together to form edges which are scaled to maintain the hot combustion products therein.

Various improvements in sealing elements incorporating planar and other flange portions have been developed. One form of edge sealing structure of the prior art is set forth in U.S. Pat. No. 4,739,746 to Tomlinson. In that structure, a pair of individual plates are proformed to define opposed recesses, and the edges of the respective clamshell plates are secured together in scaled relationship by a terminal end portion of the plate having one plate flange portion wrapped and bent around the other plate flange portion, and then having both plate flange portions crimped across the longitudinal extent thereof by means of a cylindrical-shaped depression imposed longitudinally upon both of the respective plate flange portions.

Another edge sealing mechanism comprising crimped edges of the respective top and bottom heat exchanger clamshell plates is shown in U.S. Pat. No. 4,986,785 to Tomlinson. In this form of crimped edges, the edge of a top plate extends outwardly and bends downwardly to project from the crimped edge. Another bend is made near the end of the top plate. The corresponding edge of the bottom plate is then wrapped around the edge of the top plate. A gap exists between the plates and where the bottom plate wraps around the terminal portion of the edge of the top plate. Such gap allows the metal of the top plate to expand without adversely affecting the coupling, so that the top plate does not press against the bottom plate. After this wrapping of the bottom plate over the top plate, a perforation crimping is applied in and to the top surface of the wrapped-around portion, or fold, of the bottom plate. The gap and the perforated crimping edge features together form a plurality of gussets which are necessary to maintain a seal between the two plates. The gussets are set forth in evenly spaced array, and function to stretch the plate material to make the juncture tight from one end to the other, in order to assist in maintaining the seal. In this prior art gussetted structure, the bend near the end of the top plate is bent in a direction away from the terminal portion of the edge of the bottom plate.

In these and other prior art edge sealing mechanisms, various defects, disadvantages and deficiencies have been noted. In particular, the use of a bend of the edge portions of the top and bottom plates in a direction away from the terminal portion of the edge of the top plate (i.e., away from the joint) has caused opening up of the joint. Moreover, the use of such a bend away from the joint has necessitated the use of additional supplemental perforations or crimped edges (such as gussets) in order to attempt to maintain the seal. Consequently, the necessity for use of additional gussetting has resulted in the further necessity of processing by means of additional equipment, and that further processing enhances the possibility of error in the formation of these clamshell heat exchangers. Yet additionally, the necessity for the use of such gussetted edge structures has resulted in additional expense in the working and formation of such clamshell heat exchanger mechanisms.

In light of the above defects, disadvantages and deficiencies of the prior art, it is a material object of the improved sealing mechanism for a clamshell heat exchanger of the present invention to provide improved functioning, and to do so by means of a simplified and more stable structural mechanism.

It is also a material object of the improved edge seal mechanism for a clamshell heat exchanger of the present invention to provide a stable edge seal structure which will materially alleviate the tendency for the joint to open up as found in prior art edge seal structures.

These and other objects of the improved edge seal structure for a clamshell heat exchanger of the present invention will be better understood by those skilled in the art upon review of the following summary of the invention, brief description of the drawing, detailed description of preferred embodiments, appended claims and accompanying drawing.

SUMMARY OF THE INVENTION

The edge seal mechanism of the present invention may be used in connection with clamshell or other formed sheet metal heat exchanger apparatus of the kind utilized for directing hot flue gases into a defined combustion chamber and into various forms of flue passes for radiation from such heat exchanger combustion chamber.

In particular, the improved edge seal structure for a clamshell heat exchanger of the present invention includes a first plate flange portion, around which a second flange plate portion is wrapped to define a channel for disposition of the first plate flange portion therebetween. This wrapped structure allows for contraction and expansion of the plates of the clamshell heat exchanger, such as may occur at the various temperature(s) of operation in the heat exchange process. The seal between the first and second flange portion is further formed and stabilized by means of a lateral bend in the thus channeled first and second flange portions, with such lateral bend being in the direction of and toward the terminal portion of the second plate flange (i.e., in the direction of the joint) in order to secure maintenance of the seal between the first and second plate flange portions.

In regard to the hereinafter described drawing, certain preferred embodiments are set forward; however, various modifications and alternative embodiments and constructions can be made without departing from the true spirit and scope of the present invention.

BRIEF DESCRIPTION OF THE DRAWING.

The improved edge seal mechanism of the present invention is pictorially set forth in the following described figures of the drawing, wherein common reference numerals are utilized for common elements, and in which.

DETAILED DESCRIPTION OF PREFERRED EMBODIMENTS

Figure 1:
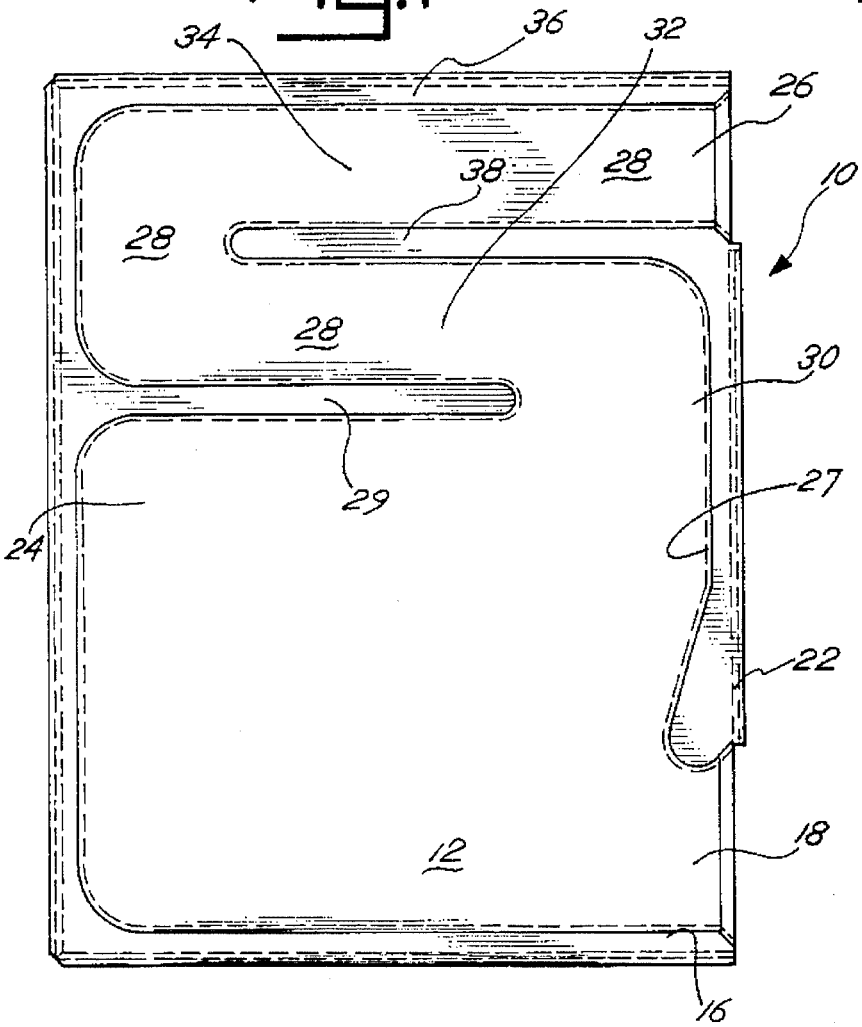
FIG. 1 is a longitudinal cross-sectional view of a clamshell heat exchanger of the type utilizable with the improved edge seal structure of the present invention, and including a lower combustion chamber having an opening therein for access entry by combusting gases, such as from a principal burner and/or from a pilot burner, and showing paired upper flue pass chambers disposed above the lower combustion chamber for serial flow therethrough of heated combustion gases.

The improved edge seal mechanism of the present invention may be utilized with clamshell and other forms of heat exchanger apparatus. Heat exchangers may be formed from first and second opposed heat exchanger side plates, comprising sheet metal, for example. Such heat exchanger side plates of such apparatus define a passageway therebetween for the hot products of combustion therethrough and for radiation therefrom. These side plates are joined at their respective edges by the plate edge sealing means hereof for providing a seal at the plate edge. In particular, each of the first and second plates has a flange portion. The second plate flange portion is disposed around and contacts the first plate flange portion to define a channel for disposition of the first plate flange portion thereinto. This structure permits the expansion and contraction of the first and second plates while simultaneously maintaining the seal between the first and second plates at the edge portion. The second plate edge portion further defines a terminal portion thereof. The first and second plate flange portions are bent laterally to define an angle of bending in the direction of and toward the terminal portion of the second plate flange (i,e., towards the formed joint) in order to secure maintenance of the seal between the first and second plate flange portions.

In preferred embodiments of the plate edge sealing mechanism of the present invention and as described in greater detail, infra, the first and second flange portions have base portions which are disposed adjacent the respective side plates. These first and second base portions are disposed in mutually and substantially parallel array.

The laterally bent first and second plate portions are mutually bent at an angle of approximately 45 degrees towards the terminal portion of the second plate flange in preferred embodiments, although other angles of bending in the direction of the joint may alternatively be utilized. This angle of bending defines a proximally disposed base portion of the first and second plate flanges and a distally disposed locking portion. In these and other preferred embodiments, the channel of the second plate flange is disposed distally of the angle of bend. Also, in preferred embodiments, the proximately disposed base portion of the first and second plate flanges is substantially planar in longitudinal dimension. This structure permits the elimination of supplemental gussetting or other indentations of the prior art, such as have been required for adequate securement and/or maintenance of sealing relationship between the first and second flange portions of prior art devices. Yet additionally, in preferred embodiments the distally disposed locking portion of the first and second plate flanges is likewise substantially planar in longitudinal dimensional shape.

In these and other preferred embodiments, the first plate flange portion has a lateral edge surface at the extreme distal portion thereof, and the channel of the second plate flange has a bottom portion thereof. The channel bottom portion has a shape in transverse cross-section which matches the transverse cross-sectional shape at the lateral edge surface of the first plate flange portion. The channel bottom shape of the second plate flange may be preferably rounded in cross-sectional shape, the first plate flange portion lateral edge surface may likewise be rounded in cross-sectional shape, and preferred embodiments hereof have a substantially identical radius of curvature of these elements to engage snugly the respective mating rounded surfaces.

Referring now to the drawing, wherein one exemplary format of the heat exchanger edge sealing structure hereof is set forth, one form of a suitable clamshell heat exchanger apparatus generally 10 is depicted. Heat exchanger apparatus 10 includes a lower disposed combustion chamber 12. A principal burner (not shown) preferably for burning a gaseous fuel is disposed at the lower portion 16 of heat exchanger 10 to inject combusting fuel and air to form a heated air stream flowing into access opening 18 therein. A plurality of principal burners, each having a corresponding sectional heat exchanger 10 of the structure such as shown may be disposed in operative and spaced array in a single furnace.

A pilot burner (not shown) also may be disposed adjacent the front wall 22 of lower portion 16 of lower combustion chamber 12, and at access opening 18 thereinto, and is utilized for igniting the principal burner upon a suitable signal of known methods, and in order to render the principal burner into the burner-"on" position.

Lower combustion chamber 12 defines a sinuous flow path for the combusting fuel when the principal burner is in the burner-"on" position. Of course, other structures having other flow paths may be utilized in conjunction with the edge sealing invention hereof. However, a detailed description of one form of a suitable clamshell heat exchanger with a defined heated air stream flow path is set forth for completeness. For example, the sinuous flow path shown in FIG. 1 is first rearwardly directed into lower portion 16 of lower combustion chamber 12, and may thereafter reflexively be directed forwardly therefrom at upper portion 24 of lower disposed combustion chamber 12. Lower combustion chamber 12 also simultaneously defines an upwardly directed pilot burner heated air stream which is disposed adjacent front wall 22 of heat exchanger lower combustion chamber 12 for the flow of the pilot burner heated air stream adjacent to front wall 22, when the principal burner is in the burner-"off" position. A combustion gas exit 26 is provided for exiting flow of the heated air stream from the principal burner and from the pilot burner.

According to the above exemplary structure, the heat energy from each of principal burner heated air stream and the pilot burner heated air stream (i.e., when the principal burner is respectively in the burner-"on" and the burner-"off" positions) is disposed adjacent and flows onto the inner surface 27 of front wall 22 of lower combustion chamber 12.

As shown in FIG. 1, heat exchanger 10 further includes a flue pass chamber 28, which is also formed of a suitable heat conducting material, and which is disposed above lower combustion chamber 12 and separated therefrom by a septum 29. The flue pass chamber 28 is formed integrally (such as, by stamping from a single plate) with lower combustion chamber 12. Flue pass chamber 28 receives the heated air stream of lower combustion chamber 12 at the lower, front portion 30 of flue pass chamber 28. Such heated air stream is likewise received adjacent the front wall 22 of lower combustion chamber 12. Flue pass chamber 28 of the heat exchanger 10 hereof includes at least lower and upper flue passes 32,34 for respectively directing the heated air stream at least rearwardly and then forwardly.

A combustion gas exit 26 is disposed at upper flue pass 34 and near the top 36 of heat exchanger 10 and adjacent to front wall 22 thereof. Combustion gas exit 26 receives the heated air stream from upper flue pass 34 for exiting the heat exchanger 10. Such combustion gas exit 26 is disposed above, and in the embodiment shown in FIG. 1 in a direct line above the access opening 18 for principal burner 14.

The lower and upper flue passes 32,34 in flue pass chamber 32 of heat exchanger 10 are defined by at least a single flue pass septum 38 which is disposed within flue pass chamber 32. Flue pass septurn 38 extends from front wall 22, and is sealingly secured to, and is shown to be formed integrally with inner surface 27 of front wall 22 of heat exchanger 10.

Figure 2:
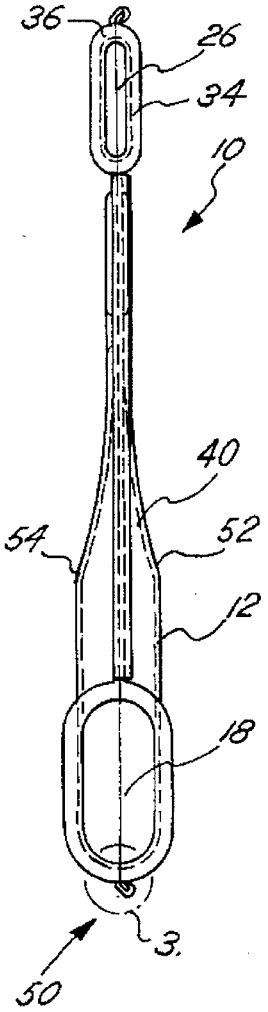
FIG. 2 is a front view of an exemplary heat exchanger as shown in FIG. 1, and further showing at the bottom portion thereof a combustion gas opening for entry of combustion gases from the principal burner and, in this embodiment, for entry access by combustion of gases from a pilot burner thereinto, and further showing at the top thereof a combustion gas exit for flow from the flue pass chambers of the circulated heated combustion gases from the heat exchanger apparatus, and yet further showing at the bottom and the top thereof the edge seal mechanism of the present invention.

As shown in the embodiment of FIG. 2 in particular, lower combustion chamber 12 has a thickness which is substantially less than the height thereof. Also as shown in FIG. 2, lower combustion chamber 12 has a width which is substantially greater than the width of flue pass chamber 28, although other formats and dimensions are entirely appropriate for use with the improved edge seal invention hereof.

Yet further, lower combustion chamber 12 may be tapered in width at the upper portion 40 thereof. Additionally, and as shown in FIG. 2, the volume of flue pass chamber 28 may be less than, or even substantially less than, the volume of lower combustion chamber 12.

Figure 3:
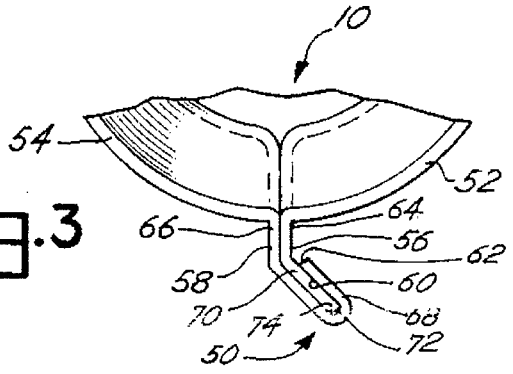
FIG. 3 is a greatly enlarged, fragmented, transverse cross-sectional view of the improved edge seal mechanism of the present invention as shown inside reference circle 3 of FIG. 2, and showing the flange portions of first and second heat exchanger side plates with the second plate flange portion disposed around and contacting the first plate flange portion to define a channel for disposition of the first plate flange portion thereinto, and in order to allow expansion and contraction of the First and second plates while maintaining the seal between the first and second plates, and further showing the first and second plate flange portions being bent laterally to define an angle of bending in the direction of the terminal portion of the second plate Flange (i,e., towards the joint) in order to secure maintenance of the seal between the first and second plate flange portions.

As shown in FIGS. 2 and 3, the improved edge seal mechanism generally 50 of the present invention is to be utilized both with clamshell formed heat exchanger apparatus 10 as shown in FIGS. 1 and 2, or with other formats. Heat exchanger 10 is formed from first and second opposed sheet metal heat exchanger side plates 52, 54. Such heat exchanger side plates 52, 54 in heat exchanger apparatus 10 define passageways 12, 28 for the hot products of combustion therethrough and for radiation therefrom. As shown in FIGS. 1 and 2 side plates 52, 54 are joined at their respective edges by the plate edge sealing apparatus, as shown in FIGS. 1–3, and for providing a seal at the respective plate edges. Each of the first and second side plates 52, 54 has a flange portion respectively 56, 58. The second plate flange portion 58 is disposed around and contacts the first plate flange portion 56 to define a channel 60 for disposition of first plate flange portion 56 thereinto. This structure permits the expansion and contraction of the first and second plates 52, 54 while simultaneously maintaining the seal between the first and second plates 52, 54 at the edge portions thereof. The second plate flange portion 58 further defines a terminal portion 62. The first and second plate flange portions 56, 58 are bent laterally to define an angle of bending in the direction of the terminal portion 62 of the second plate flange 58 (i.e., towards the formed joint) in order to secure maintenance of the seal between the first and second plate flange portions 56, 58.

In plate edge sealing mechanism 50, first and second flange portions 56, 58 have respective base portions 64, 66 which are disposed adjacent the respective side plates. First and second base portions 64, 66 are disposed in mutually and substantially parallel array, as shown in FIG. 3.

First and second flange portions 56, 58 are mutually bent at an angle of approximately 45 degrees towards terminal portion 62 of second plate flange portion 58, as shown, although other angles of bending in the direction of the joint may also be utilized. This angle of bending defines the proximally disposed base portion 64, 66 of the first and second plate flanges 56, 58 and respective distally disposed locking portions 68, 70. Channel 60 of second plate flange 58 is disposed distally of the angle of bend.

Proximally disposed base portions 64, 66 of first and second plate flanges 56, 58 are substantially planar in longitudinal dimension. As indicated, supra, this structure permits the elimination of supplemental gussetting or other indentations of the prior art, such as have been required for adequate securement and/or maintenance of sealing relationship between the first and second flange portions of prior art devices. Yet additionally, the distally disposed locking portions 68, 70 of first and second plate flanges 56, 58 are likewise substantially planar in longitudinal dimensional shape.

First plate flange portion 56 has a lateral edge surface 72 at the extreme distal portion thereof, as shown in FIG. 3, and lateral edge portion 72 is preferably rounded in transverse cross-sectional shape, although other shapes are contemplated. Channel 62 of second plate flange 58 has a bottom portion thereof 74 which matches the transverse cross-sectional shape at the lateral edge portion 72 of first plate flange portion 56. Channel bottom 74 is rounded in cross-sectional shape, first plate flange portion lateral edge surface 72 is likewise be rounded in cross-sectional shape, and has a substantially identical radius to engage snugly the respective mating rounded surfaces.

The basic and novel characteristics of the improved methods and apparatus of the present invention will be readily understood from the foregoing disclosure by those skilled in the art. It will become readily apparent that various changes and modifications may be made in the form, construction and arrangement of the improved apparatus of the present invention, and in the steps of the inventive methods hereof, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. In a gas furnace clamshell heat exchanger in which hot products of combustion are formed by burning fuel and air, said heat exchanger having first and second sheet metal heat exchanger side plates defining a passageway for the hot products of combustion and for radiation therefrom, and having said side plates joined at their respective edges by a plate edge sealing means for providing a seal thereat, the improvement comprising:

a flange portion disposed from said first plate and a flange portion disposed from said second plate, said first plate flange portion having an inner edge and said second plate flange portion having an inner edge the inner edge of the first plate flange portion being aligned with the inner edge of the second plate flange portion, said first plate flange portion having an exterior contacting surface and said second plate flange portion having an interior contacting surface, said second plate flange portion further disposed around and contacting said first plate flange portion to define a channel for disposition of said first plate flange portion therein to allow expansion and contraction of said first and second plates while maintaining the seal between said first and second plates; said exterior contacting surface of said first plate flange portion disposed in intimate contact with said interior contacting surface of said second plate flange portion throughout substantially the entirety of said exterior contacting surface and said interior contacting surface to seal against the escape of hot products of combustion from said passageway;

said second plate flange portion having a terminal portion, said first and second plate flange portions bent laterally at an acute angle of bending in the direction of said terminal portion of said second plate flange to secure maintenance of said seal between said first and second plate flange portions said acute angle of bending being defined with respect to the surface of the first and second plate flange portions;

said first and second plate flange portions having base portions disposed adjacent their respective side plates, said respective side plates mutually abutting said respective first and second plate flange portions and said flange first and second base portions disposed in mutually and substantially parallel array at said respective base portions thereof.

2. The improvement in plate edge sealing means for clamshell heat exchangers of claim 1 wherein said laterally bent first and second plate portions are mutually bent at an angle of approximately 45° towards said terminal portion of said second plate flange.

3. The improvement in plate edge sealing means for clamshell heat exchangers of claim 1 wherein said angle of bending defines a proximally disposed base portion of said first and second plate flanges and a distally disposed locking portion.

4. The improvement in plate edge sealing means for clamshell heat exchangers of claim 3 wherein said elongate means of said second plate flange is disposed distally of said angle of bend.

5. The improvement in plate edge sealing means for clamshell heat exchangers of claim 3 wherein said proximally disposed base portion of said first and second plate flanges is substantially planar in a longitudinal dimension, whereby supplemental gussetting indentations are not required for securement and maintenance of the seal between said first and second flange portions.

6. The improvement in plate edge sealing means for clamshell heat exchangers of claim 3 wherein said distally disposed locking portion of said first and second plate flanges is substantially planar in a longitudinal dimension, whereby supplemental gussetting indentations are not required for securement and maintenance of seal between said first and second flange portions.

7. The improvement in plate edge sealing means for clamshell heat exchangers of claim 3 wherein said first plate flange portion has a lateral edge surface at the extreme distal portion thereof and said lateral edge portion is rounded in transverse cross-sectional shape.

8. The improvement in plate edge sealing means for clamshell heat exchangers of claim 3 wherein said first plate flange portion has a lateral edge surface at the extreme distal portion thereof, said elongate channel means of said second plate flange has a bottom thereof, and the bottom of said elongate channel means has a shape in transverse cross-section which matches the transverse cross-sectional shape of said lateral edge surface of said first plate flange portion.

9. The improvement in plate edge sealing means for clamshell heat exchangers of claim 3 wherein said channel means of said second plate flange has a bottom that is rounded in cross-sectional shape, and said first plate flange portion lateral edge surface is likewise rounded in cross-sectional shape of substantially identical radius mutually to engage snugly said respective mating rounded surfaces.

10. In a gas furnace clamshell heat exchanger in which hot products of combustion are formed by burning fuel and air, said heat exchanger having first and second sheet metal heat exchanger side plates defining a passageway for the hot products of combustion and for radiation therefrom, and having said side plates joined at their respective edges by a plate edge sealing means for providing a seal thereat, the improvement comprising:

a flange portion disposed from said first plate and a flange portion disposed from said second plate, said first plate flange portion having an inner edge, and said second plate flange portion having an inner edge, the inner edge of the first plate flange portion being aligned with the inner edge of the second plate flange portion, said first plate flange portion having an exterior contacting surface and said second plate flange portion having an interior contacting surface, said second plate flange portion further disposed around and contacting said first plate flange portion to define a channel for disposition of said first plate flange portion therein to allow expansion and contraction of said first and second plates while maintaining the seal between said first and second plates; said exterior contacting surface of said first plate flange portion disposed in intimate contact with said interior contacting surface of said second plate flange portion throughout substantially the entirety of said exterior contacting surface and said interior contacting surface to seal against the escape of hot products of combustion from said passageway;

said second plate flange portion having a terminal portion, said first and second plate flange portions bent laterally at an angle of bending in the direction of said terminal portion of said second plate flange to secure maintenance of said seal between said first and second plate flange portions, said angle of bending being less than 90°; said angle of bending being defined with respect to the surfaces of the first and second plate flange portions;

said first and second plate flange portions having base portions disposed adjacent their respective side plates, said respective side plates mutually abutting said respective first and second plate flange portions and said first and second base portions disposed in mutually and substantially parallel array at said respective base portions thereof.

11. The improvement of claim 10 wherein the said angle of bending is on the order of approximately 45°.

* * * * *